US010280642B2

(12) United States Patent
Zhao et al.

(10) Patent No.: US 10,280,642 B2
(45) Date of Patent: May 7, 2019

(54) CONNECTING GUSSET PLATE WITH SLIDING END PLATE FOR BUCKLING-RESTRAINED BRACE

(71) Applicants: SOUTH CHINA UNIVERSITY OF TECHNOLOGY, Guangdong (CN); BEIJING BRACE DAMPER TECHNOLOGY CO., LTD., Beijing (CN); CHINA CONSTRUCTION EIGHTH ENGINEERING DIVISION.CORP.LTD, Shanghai (CN)

(72) Inventors: Junxian Zhao, Beijing (CN); Ruobing Chen, Beijing (CN); Haichao Yu, Beijing (CN); Wei Han, Beijing (CN)

(73) Assignees: SOUTH CHINA UNIVERSITY OF TECHNOLOGY, Guangdong (CN); BEIJING BRACE DAMPER TECHNOLOGY CO., LTD., Beijing ( * ) Notice: Subject to any disclaimer, the term of this patent is extended or adjusted under 35 U.S.C. 154(b) by 0 days.

(21) Appl. No.: 16/075,590

(22) PCT Filed: Mar. 6, 2017

(86) PCT No.: PCT/CN2017/075772
§ 371 (c)(1),
(2) Date: Aug. 3, 2018

(87) PCT Pub. No.: WO2017/197960
PCT Pub. Date: Nov. 23, 2017

(65) Prior Publication Data
US 2019/0040645 A1 Feb. 7, 2019

(30) Foreign Application Priority Data
May 19, 2016 (CN) ..... 2016 1 0333205

(51) Int. Cl.
*E04B 1/98* (2006.01)
*E04H 9/02* (2006.01)
(Continued)

(52) U.S. Cl.
CPC ..... *E04H 9/021* (2013.01); *E04B 1/2403* (2013.01); *E04B 1/5812* (2013.01); *E04B 1/98* (2013.01);
(Continued)

(58) Field of Classification Search
CPC ..... E04B 1/98; E04B 1/2403; E04B 1/5812; E04B 2001/2415; E04H 9/021; E04H 9/024
See application file for complete search history.

(56) References Cited

U.S. PATENT DOCUMENTS
5,660,017 A * 8/1997 Houghton ..... E04B 1/2403 52/167.3
7,299,596 B2 * 11/2007 Hildreth ..... E04B 1/24 52/223.6
7,784,226 B2 * 8/2010 Ichikawa ..... E04H 9/02 52/167.1
8,365,476 B2 2/2013 Richard et al.
8,505,260 B1 * 8/2013 Chang ..... E04H 9/02 52/167.3
(Continued)

FOREIGN PATENT DOCUMENTS
CN 102296704 A 12/2011
CN 203096993 A 7/2013
(Continued)

OTHER PUBLICATIONS
International Search Report and Written Opinion issued for corresponding International Application No. PCT/CN2017/075772 dated Jun. 13, 2017.

*Primary Examiner* — Paola Agudelo
(74) *Attorney, Agent, or Firm* — FisherBroyles LLP; Anthony J DoVale

(57) ABSTRACT

Disclosed is a gusset plate connection with sliding end plates for a buckling-restrained brace, including central plate (1), first rib plate (2), second rib plate (3), horizontal end plate (4), first horizontal tie plate (5), second horizontal tie plate (6), bolts (7) and unbonding layers (8). Horizontal end plate (4) is perpendicular to central plate (1) and fixedly disposed on a lower end surface of central plate (1). First horizontal tie plate (5) and second horizontal tie plate (6) are both disposed on an upper surface of horizontal end plate (4) and are located at two sides of central plate (1), respectively. Unbonding layers (8) are each disposed at a bottom surface of horizontal end plate (4), between horizontal end plate (4) and first horizontal tie plate (5), and between horizontal end plate (4) and second horizontal tie plate (6). The components are connected by means of bolts (7).

20 Claims, 4 Drawing Sheets

(51) Int. Cl.
*E04B 1/58* (2006.01)
*E04B 1/24* (2006.01)

(52) U.S. Cl.
CPC ..... *E04H 9/024* (2013.01); *E04B 2001/2415* (2013.01); *E04B 2001/2448* (2013.01); *E04B 2001/2457* (2013.01)

(56) References Cited

U.S. PATENT DOCUMENTS

| | | | | |
|---|---|---|---|---|
| 8,925,278 | B2 * | 1/2015 | Sugihara | E04B 1/58 52/167.3 |
| 9,631,357 | B2 * | 4/2017 | Allen | E04H 9/021 |
| 2004/0211140 | A1 * | 10/2004 | Suzuki | E04B 1/24 52/393 |
| 2005/0005561 | A1 * | 1/2005 | Hanson | E04B 1/24 52/633 |
| 2007/0245643 | A1 * | 10/2007 | Ichikawa | E04H 9/02 52/167.3 |
| 2009/0165419 | A1 | 7/2009 | Richard et al. | |
| 2009/0223166 | A1 * | 9/2009 | Ohata | E04B 1/2403 52/699 |
| 2013/0074440 | A1 | 3/2013 | Black et al. | |
| 2015/0218838 | A1 * | 8/2015 | Ichikawa | E04H 9/021 52/167.3 |
| 2016/0356033 | A1 * | 12/2016 | Houghton | E04B 1/2403 |

FOREIGN PATENT DOCUMENTS

| | | | |
|---|---|---|---|
| CN | 104563304 | A | 4/2015 |
| CN | 105839968 | A | 8/2016 |
| JP | 2007277952 | A | 10/2007 |
| JP | 2014088657 | A | 5/2014 |

* cited by examiner

CONNECTING GUSSET PLATE WITH SLIDING END PLATE FOR BUCKLING-RESTRAINED BRACE

CROSS REFERENCE TO RELATED APPLICATION

The present disclosure claims priority to Chinese Patent Application No. 201610333205.0, filed on May 19, 2016, and entitled "Gusset Plate Connection with Sliding End Plates for Buckling-Restrained Brace", which is incorporated herein by reference in its entirety.

TECHNICAL FIELD

The present disclosure relates to the technical field of civil architectural structures, and in particular to a gusset plate connection with sliding end plates for buckling-restrained brace.

BACKGROUND ART

Buckling-restrained braces are currently used, as a new type of energy dissipation-seismic reduction members, in civil architectural structures, especially in multistoried tall buildings. The buckling-restrained brace provides lateral stiffness to the structure during a small earthquake, and tends to dissipate earthquake energy during a moderate or large earthquake. In practical application, the buckling-restrained brace must be connected to beam and column by a gusset plate. FIG. 1 is a structural diagram showing the overall connection between a buckling-restrained brace and a beam or column. FIG. 2 is a structurally schematic diagram of a traditional gusset plate connection for buckling-restrained brace. As shown in FIGS. 1 and 2, in the traditional connection method, the gusset plate is connected to flanges of the steel beam and column by means of fillet welds, wherein the gusset plate for buckling-restrained brace comprises a central plate 1, a first rib plate and a second rib plate. Such connection type has the following problems:

1. Problem of Rigid Zone at Brace-Beam-Column Joints

Since the gusset plate has large in-plane stiffness, the rotational stiffness of a beam-column joint may be significantly increased, resulting in the formation of a rigid zone effect at the beam-column joint. The currently existing tests and finite element analysis results show that such rigid zone effect may significantly increase the lateral stiffness of the main structure and result in an increase of the seismic shear force sustained by the structure, thereby causing premature failure of the structure (see the second point for details), which in turn weakens the advantageous effects that the buckling-restrained braced structure should possess. However, during the design of structures, engineers often neglect the impacts of this rigid zone effect due to the problems such as complication of computer modeling, which will result in a large deviation between the actual performance and the designed performance of the buckling-restrained braced structure system, leading to potential man-made risk to the safety of such structures when subjected to a large earthquake.

2. Transfer of Failure Mode of the Beam-Column and Change in the Effective Length Thereof The results of tests for the buckling-restrained braced frames existing in China and abroad show that the rigid zone effect may cause the transfer of yielding (failure) section of the beam-column from the end of the beam to the end of the gusset plate, and cause a peak value of plastic deformation thereof to be 32 times of that of a model without a rigid zone. In addition, the rigid zone effect may decrease an effective length of the beam-column, cause the failure mode of the beam-column to be transferred from bending failure to shear failure, and aggravate the tendency of brittle failure in the reinforced concrete beam-column member, which will be fatal in a large earthquake.

3. Adverse Impact of the Opening-Closing Effect of the Beam-Column on the Gusset Plate The studies show that the beam and column will experience significant bending deformation (the flanges thereof are subjected to elongating or compressive deformation) under the seismic shear force. But the rigid zone effect of the gusset plate restrains the beam and column from deforming freely. An additional acting force (termed Opening-Closing effect) is thus generated at the connection welds between the gusset plate and the flanges of the beam and column, causing premature fracture of the connection weld of the gusset plate, and even leading to out-of-plane buckling failure of the gusset plate in the case that the brace is tensioned. However, such Opening-Closing effect has not been fully taken into account in the prior gusset plate designing methods, so that the connection of the gusset plate in turn becomes a vulnerable spot, which is contrary to "strong connection, weak member" principle of seismic design, and cannot guarantee the full exertion of the energy-dissipating capability of the buckling-restrained braces.

In view of the above, in an earthquake, especially a large earthquake, significant in-plane interaction effect will be present between a structure and a gusset plate, which will adversely impact the seismic performance of the structure and the connection performance of the gusset plate. Moreover, it remains difficult to provide full consideration to the adverse impacts in the design of the structure, and it is impossible to quantitatively guarantee the safety of the buckling-restrained brace structure under a large earthquake or major earthquake.

SUMMARY OF THE DISCLOSURE

An object of the present disclosure is to provide a gusset plate connection with sliding end plates for a buckling-restrained brace in order to solve the problems existing in the gusset plates connection of the prior art such as the rigid zone effect caused by the weld connection, shortening of the effective length of the beam-column, and the Opening-Closing effect generated by the structure on the gusset plate.

In order to achieve the above object, the present disclosure provides the following technical solutions:

A gusset plate connection with sliding end plates for a buckling-restrained brace according to the present disclosure includes a central plate, a first rib plate and a second rib plate, and further includes a horizontal end plate, a first horizontal tie plate, a second horizontal tie plate, bolts, and unbonding layers. The horizontal end plate is perpendicular to the central plate, and is fixedly disposed to the first rib plate on a lower end surface of the central plate. The first horizontal tie plate and the second horizontal tie plate are both disposed on an upper surface of the horizontal end plate, and are located at two sides of the central plate, respectively. The horizontal end plate is provided thereon with first through holes, the first horizontal tie plate and the second horizontal tie plate are each provided with a first mounting hole at positions corresponding to the first through holes, and the bolts can pass through the first mounting holes, the first through holes and positioning holes in a steel beam, respectively, and can be screwed with nuts. The unbonding layers are each disposed at a bottom surface of the horizontal end plate, between the horizontal end plate and the first horizontal tie plate, and between the horizontal end plate and the second horizontal tie plate, respectively.

Further, the first through holes are in clearance fit with the bolts. This technical solution has a technical effect that since the first through holes fit the bolts with clearance, the steel beam can slide horizontally to a certain degree with respect to the horizontal end plate and the central plate in the case where the bolt does not bear a force and bend, so that the central plate is prevented from generating tangential shear stress, and is mainly subjected to the normal stress caused by the brace axial force.

Further, each of the first through holes is a long slot. This technical solution has a technical effect that the direction for the length of the long slot is designed to be the same as the direction for the length of the horizontal end plate, and the long slot can increase the size for clearance fit between the bolt and the first through hole so as to prevent the bolt from bearing an additional shear force during sliding.

Further, a vertical end plate, a first vertical tie plate, and a second vertical tie plate are further included. The vertical end plate is perpendicular to each of the central plate and the horizontal end plate, and is fixedly disposed, corresponding to the second rib plate, on a left end surface of the central plate. The first vertical tie plate and the second vertical tie plate are both disposed on a right surface of the vertical end plate, and are each located at one of two sides of the central plate. The vertical end plate is provided thereon with second through holes. The first vertical tie plate and the second vertical tie plate are each provided with a second mounting hole at positions corresponding to the second through holes. The bolts can pass through the second mounting holes, the second through holes, and positioning holes in a steel column, respectively, and can be screwed with nuts. The unbonding layers are each disposed at a left surface of the vertical end plate, between the vertical end plate and the first vertical tie plate, and between the vertical end plate and the second vertical tie plate, respectively. This technical solution has a technical effect that the vertical end plate, the first vertical tie plate, the second vertical tie plate and the unbonding layers are mounted as a composite structure by means of the bolts, the second mounting holes and the second through holes, such that the column can slide in a vertical direction to a certain degree with respect to the vertical end plate and the central plate, which reduces the adverse impact of the Opening-Closing effect of the beam-column in the vertical direction on the gusset plate.

Further, each of the second through holes is a long slot. This technical solution has a technical effect that the direction for the length of the long slot is designed to be the same as the direction for the length of the vertical end plate. The long slot can increase the size for clearance fit between the bolt and the second through hole, which allows for relative deformation between the column and the central plate in the vertical direction so as to reduce the adverse impact of the Opening-Closing effect of the beam-column on the gusset plate.

Further, the first through holes and the second through holes are each provided in number of more than one. This technical solution has a technical effect that a plurality of the first through holes and a plurality of the second through holes can uniformly disperse the sliding deformations of the beam-column with respect to the horizontal end plate and the vertical end plate. This avoids the phenomenon of concentrated deformation.

Further, each of the bolts is a high-strength bolt. This technical solution has a technical effect that since the gusset plate connection bears a large normal stress in the buckling-restrained brace, the transmission of a normal force between the gusset plate and the beam-column can only be guaranteed by employing the high-strength bolts.

Further, the unbonding layers may be made of a material such as butyl rubber, a self-adhesive bituminous waterproof material or the like, which have a friction coefficient of less than or equal to 0.1. This technical solution has a technical effect that the degree of relative sliding between the horizontal end plate and the steel beam and between the vertical end plate and the steel column is associated with the friction coefficient of the unbonding layers. If the unbonding layers are designed to have a relatively small friction coefficient in the contact surface between the horizontal end plate and the steel beam and in the contact surface between the vertical end plate and the steel column, elongational/compressive deformation caused by bending of the beam-column can be released smoothly.

Further, the central plate is welded to the horizontal end plate, and the central plate is welded to the vertical end plate. This technical solution has a technical effect that the central plate is welded and fixed to the horizontal end plate and the vertical end plate for better transmission of the normal stress resulted from the brace axial force, which may not only facilitate assembling but also increase the structural strength of the gusset plate connection.

The beneficial effects of the present disclosure is in that: the gusset plate connection is provided at the bottom thereof with a horizontal end plate, a first horizontal tie plate, and a second horizontal tie plate; and unbonding layers are each disposed between the horizontal end plate and the first horizontal tie plate, between the horizontal end plate and the second horizontal tie plate, and between the horizontal end plate and the steel beam; and these components are connected by bolts. This prevents the problem of the rigid zone effect caused by the traditional welded connection, the problem in shortening of the effective length of the beam-column, and the problem of the Opening-Closing effect generated by the structure on the gusset plate.

BRIEF DESCRIPTION OF DRAWINGS

For illustrating technical solutions of specific embodiments of the present disclosure more clearly, drawings required for use in the description of the specific embodiments will be introduced briefly below. As a contrast, a drawing for the prior art is also included in the accompanying drawings. It is apparent that the drawings in the following description are merely illustration of some embodiments of the present disclosure, and it would be appreciated by those skilled in the art that other drawings could also be obtained from these drawings without any inventive effort.

REFERENCE SIGNS

| | | |
|---|---|---|
| 1 - central plate; | 2 - first rib plate; | 3 - second rib plate; |
| 4 - horizontal end plate; | 5 - first horizontal tie plate; | 6 - second horizontal tie plate; |
| 7 - bolt; | 8 - unbonding layer; | 9 - first through hole; |
| 10 - first mounting hole; | 11 - vertical end plate; | 12 - first vertical tie plate; |
| 13 - second vertical tie plate; | 14 - second through hole; | 15 - second mounting hole; |
| 16 - steel beam; | 17 - steel column. | |

DETAILED DESCRIPTION OF THE DISCLOSURE

The technical solutions of the present disclosure will be described below clearly and completely with reference to the drawings. It is apparent that the embodiments to be described are part, but not all, of the embodiments of the present disclosure. All the other embodiments obtained by those skilled in the art in light of the embodiments of the present disclosure without making inventive efforts would fall within the scope of the present disclosure as claimed.

In the description of the present disclosure, it should be noted that orientation or positional relations indicated by the terms such as "center", "on", "below", "left", "right", "vertical", "horizontal", "inside", and "outside" are the orientation or positional relations shown based on the figures, and are intended only to facilitate the description of the present disclosure and simplify the description, but not intended to indicate or imply that the referred devices or elements must be in a particular orientation or constructed or operated in the particular orientation, and therefore should not be construed as limiting the present disclosure. In addition, terms such as "first", "second", and "third" are only for descriptive purpose, and should not be understood as indicating or implying any relative importance.

In the description of the present disclosure, it should be noted that unless otherwise expressly specified or defined, terms "mount", "couple", and "connect" should be understood broadly. For example, connection may be fixed connection or detachable connection or integral connection, may be mechanical connection or electric connection, or may be direct coupling or indirect coupling via an intermediate medium or internal communication between two elements. The specific meanings of the above terms in the present disclosure could be understood by those skilled in the art according to specific situations.

First Embodiment

Figure 1:
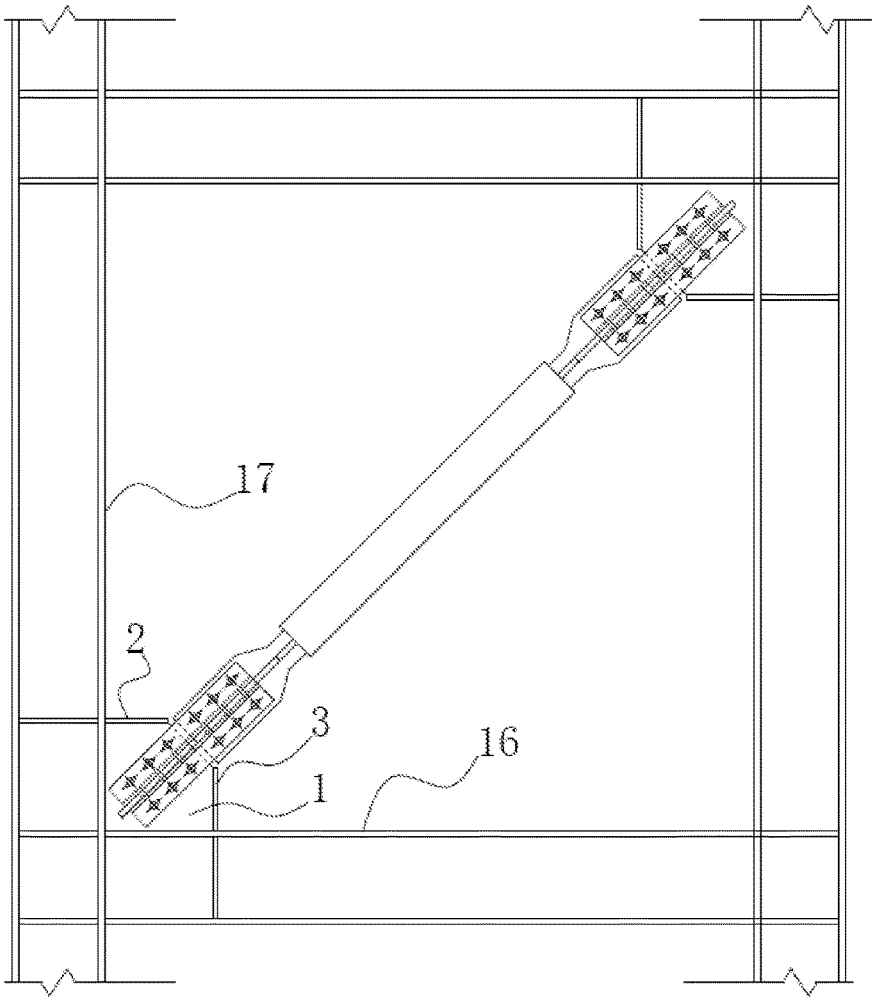
FIG. 1 is a structural diagram showing the overall connection between a buckling-restrained brace and beam column.
Figure 3:
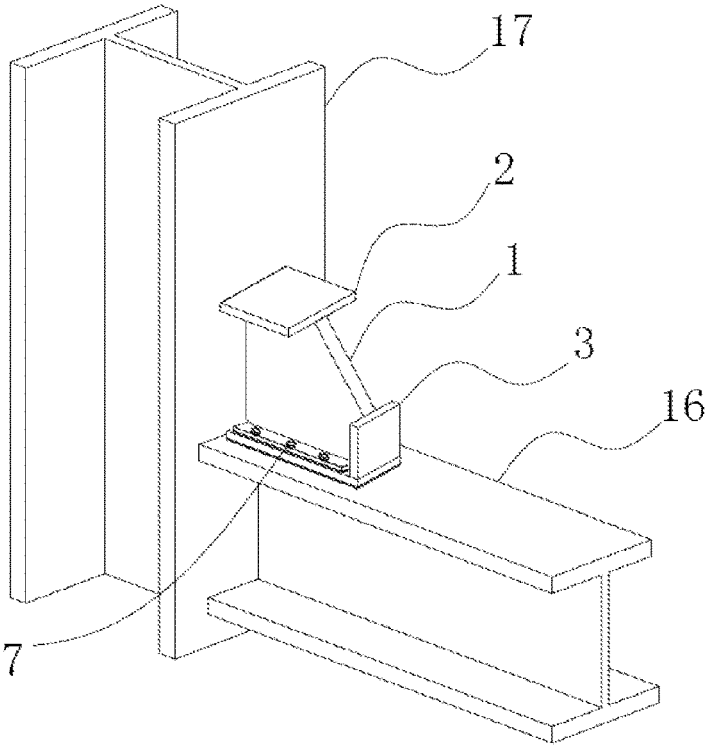
FIG. 3 is a structurally schematic diagram of a gusset plate connection with sliding end plates for a buckling-restrained brace according to a first embodiment of the present disclosure.
Figure 4:
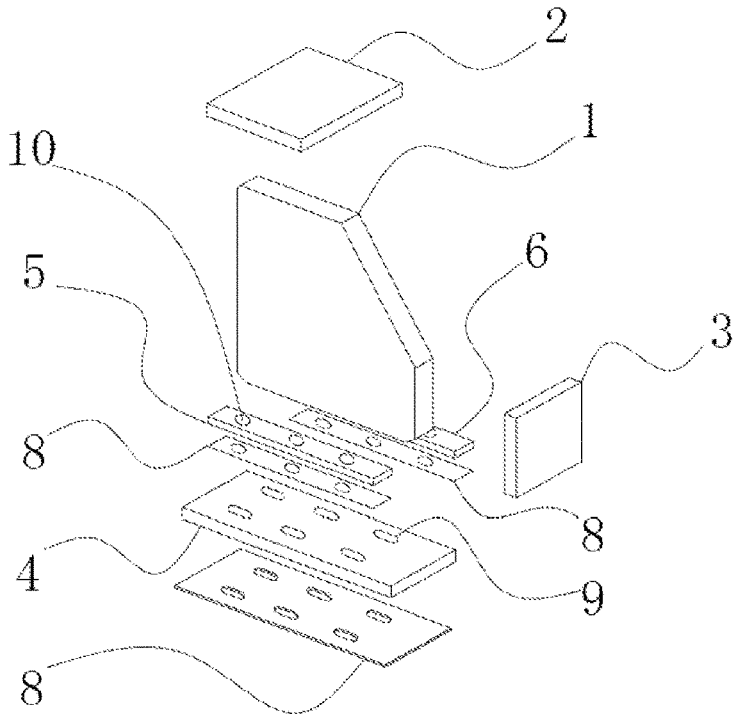
FIG. 4 is an exploded view of a gusset plate connection with sliding end plates for a buckling-restrained brace according to the first embodiment of the present disclosure.

The present embodiment provides a gusset plate conection with sliding end plates for a buckling-restrained brace, where FIG. 1 is a structural diagram showing the overall connection between a buckling-restrained brace and beam column, FIG. 3 is a structurally schematic diagram of a gusset plate connection with sliding end plates for a buckling-restrained brace provided in the first embodiment of the present disclosure, and FIG. 4 is an exploded view of the gusset plate connection with sliding end plates for a buckling-restrained brace provided in the first embodiment of the present disclosure. As shown in FIGS. 1, 3 and 4, the main structure of the gusset plate connection with sliding end plate for a buckling-restrained brace comprises a central plate 1, a first rib plate 2, a second rib plate 3, a horizontal end plate 4, a first horizontal tie plate 5, a second horizontal tie plate 6, bolts 7, and unbonding layers 8. Specifically, the horizontal end plate 4 is perpendicular to the central plate 1, and is fixedly disposed, corresponding to the first rib plate 2, on a lower end surface of the central plate 1. The first horizontal tie plate 5 and the second horizontal tie plate 6 are both disposed on an upper surface of the horizontal end plate 4, and are located at two sides of the central plate 1, respectively. The horizontal end plate 4 is provided thereon with first through holes 9. The first horizontal tie plate 5 and the second horizontal tie plate 6 are each provided with first mounting holes 10 at positions corresponding to the first through holes 9. The bolts 7 can pass through the first mounting holes 10, the first through holes 9, and positioning holes in the steel beam 16, respectively, and can be screwed with nuts. Moreover, the unbonding layers 8 are each disposed at a bottom surface of the horizontal end plate 4, between the horizontal end plate 4 and the first horizontal tie plate 5, and between the horizontal end plate 4 and the second horizontal tie plate 6.

Figure 2:
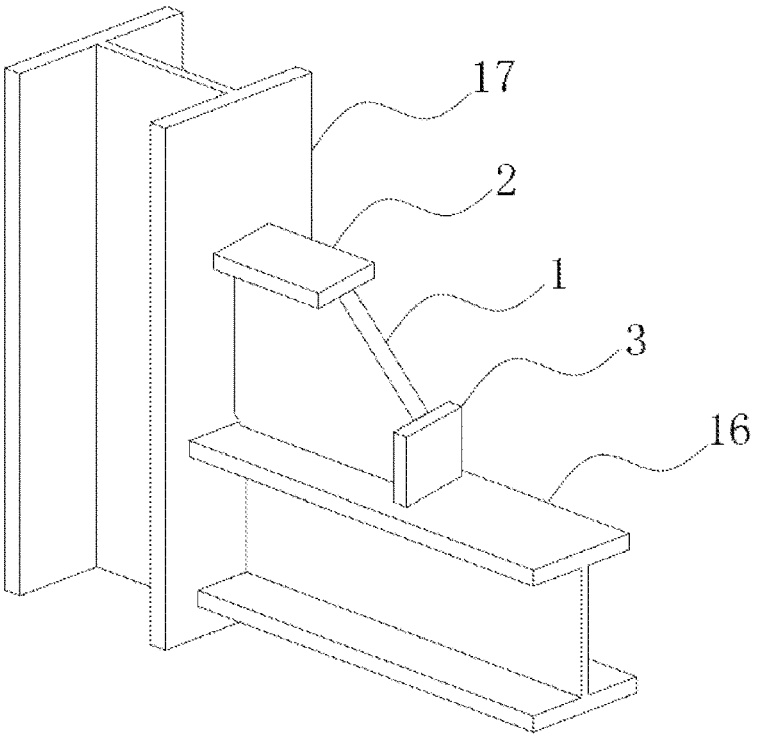
FIG. 2 is a structurally schematic diagram of a traditional gusset plate connection for a buckling-restrained brace.

In the prior art, the connection between the buckling-restrained brace and the steel beam 16 or column, is carried out by connecting the gusset plate to flanges of the steel column 17 and the steel beam 16 by means of fillet welds, where the gusset plate connection for the buckling-restrained brace only includes a central plate 1, a first rib plate 2, and a second rib plate 3. FIG. 2 is a structurally schematic diagram of a traditional gusset plate connection for a buckling-restrained brace. As shown in FIG. 2, there is a significant tangential deformation constraint between the traditional gusset plate and the beam-column, which easily leads to a problem of a rigid zone in the brace-beam column joints, a problem in transfer of the failure mode of the beam-column and change in the effective length thereof, and a problem of adverse impacts of the Opening-Closing effect of the beam-column on the gusset plate.

In contrast, the gusset plate connection with sliding end plates in the present embodiment is provided, at the bottom of the gusset plate, with a horizontal end plate 4, a first horizontal tie plate 5, and a second horizontal tie plate 6. Moreover, the unbonding layers 8 are disposed between the horizontal end plate 4 and the first horizontal tie plate 5, between the horizontal end plate 4 and the second horizontal tie plate 6, and between the horizontal end plate 4 and the steel beam 16. The components above are further connected by using bolts 7. This technical solution addresses the problems of unfavorable anti-seismic and force-bearing properties that cannot be circumvented by the traditional gusset plate connection, reduces the adverse impact of the Opening-Closing effect of the beam-column on the gusset plate, and reduces the influence of the gusset plate on the rigid zone effect and the effective length of the beam-column, such that the stress is distributed more evenly on the gusset plate, and that the gusset plate bears forces in a more reasonable manner and can be designed and constructed more simply and conveniently.

In an optional solution of the present embodiment, as shown in FIG. 4, the first through holes 9 are in clearance fit with the bolts 7. In the present embodiment, the first through holes 9 fit the bolts 7 with clearance, such that the steel beam 16 can slide horizontally to a certain degree with respect to the horizontal end plate 4 and the central plate 1 in the case where the bolt 7 does not bear a force to bend. The central plate 1 is therefore prevented from generating tangential shear stress, and is mainly subjected to the normal stress caused by the brace axial force, which reduces the unfavorable impact of the Opening-Closing effect, and allows the gusset plate to bear forces in a more rational way.

In an optional solution of the present embodiment, as shown in FIG. 4, each of the first through holes 9 is a long slot. Here, the direction for the length of the long slot is designed to be identical to the direction for the length of the horizontal end plate 4. The long slot can increase the size for clearance fit between the bolt 7 and the first through hole 9, such that the bolt 7 is prevented from being subjected to a shear force and is mainly subjected to a tension (pulling force), thereby further enhancing the force-bearing performance of the bolt 7.

Second Embodiment

Figure 5:
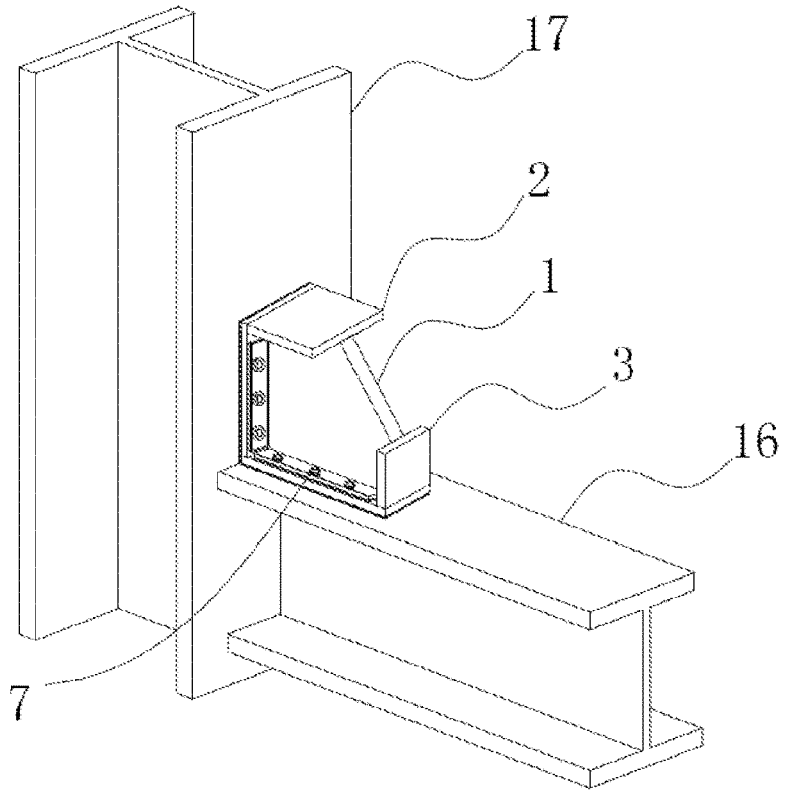
FIG. 5 is a structurally schematic diagram of a gusset plate connection with sliding end plates for a buckling-restrained brace according to a second embodiment of the present disclosure.
Figure 6:
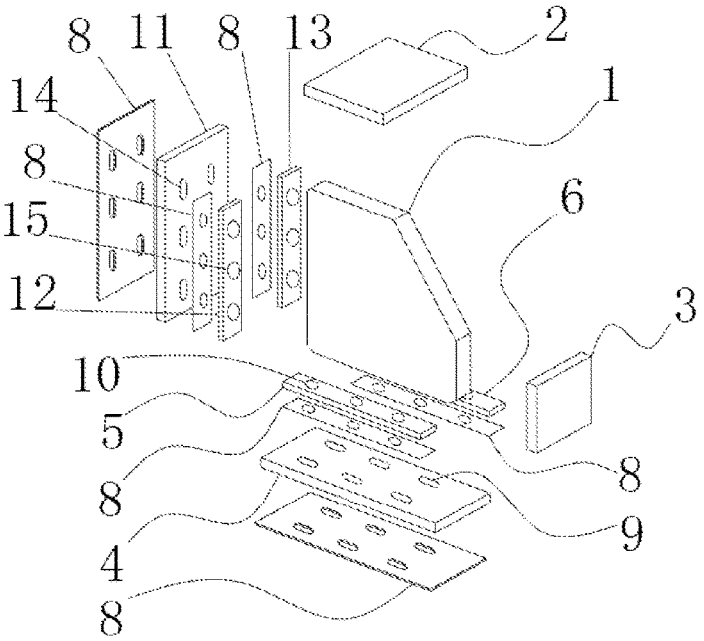
FIG. 6 is an exploded view of a gusset plate connection with sliding end plates for a buckling-restrained brace according to the second embodiment of the present disclosure.

In the second embodiment, the gusset plate connection with sliding end plates is further provided with a vertical end plate 11, a first vertical tie plate 12, and a second vertical tie plate 13. FIG. 5 is a schematic diagram of the structure of a gusset plate connection with sliding end plates for a buckling-restrained brace provided in the second embodiment of the present disclosure; and FIG. 6 is an exploded view of the gusset plate connection with sliding end plates for a buckling-restrained brace provided in the second embodiment of the present disclosure. Specifically, as shown in FIGS. 5 and 6, the vertical end plate 11 is perpendicular to both of the central plate 1 and the horizontal end plate 4, and is fixedly disposed with respect to the first rib plate 2 on a left end surface of the central plate 1. The first vertical tie plate 12 and the second vertical tie plate 13 are both disposed on a right surface of the vertical end plate 11, and are respectively located at each of the two sides of the central plate 1. The vertical end plate 11 is provided thereon with second through holes 14. The first vertical tie plate 12 and the second vertical tie plate 13 are each provided with second mounting holes 15 at positions corresponding to the second through holes 14. The bolts 7 can pass through the second mounting holes 15, the second through holes 14, and positioning holes in the steel column 17, respectively, and can be screwed with nuts. Moreover, the unbonding layers 8 are each disposed at a left surface of the vertical end plate 11, between the vertical end plate 11 and the first vertical tie plate 12, and between the vertical end plate 11 and the second vertical tie plate 13, respectively. In the present embodiment, the vertical end plate 11, the first vertical tie plate 12, the second vertical tie plate 13 and the unbonding layers 8 are mounted as a composite structure by means of the bolts 7, the second mounting holes 15 and the second through holes 14, such that the central plate 1 in the gusset plate connection has an increased room for movement in the vertical direction, which reduces the unfavorable impact of the Opening-Closing effect of the beam-column on the gusset plate in the vertical direction.

In an optional solution of the present embodiment, as shown in FIG. 6, each of the second through holes 14 is a long slot. Here, the direction for the length of the long slot is designed to be identical to the direction for the length of the vertical end plate 11. The long slot can increase the size for clearance fit between the bolts 7 and the second through holes 14, so as to prevent the bolts 7 from bearing a shear force in the vertical direction.

In an optional solution of the present embodiment, as shown in FIGS. 4 and 6, the first through holes 9 and the second through holes 14 are both provided in number of more than one. Since the plurality of the first through holes 9 and the second through holes 14 could disperse the sliding forces applied onto the horizontal end plate 4 and the vertical end plate 11, excessively concentrated sliding deformation could be avoided.

In an optional solution of the present embodiment, as shown in FIGS. 3 and 5, each of the bolts 7 is preferably a high-strength bolt 7. Since the gusset plate connection bears a large stress in the buckling-restrained brace, the transmission of a normal tension (pulling force) between the gusset plate and the beam-pillar can only be guaranteed by means of the high-strength bolts 7.

In an optional solution of the present embodiment, each of the unbonding layers 8 is selected from butyl rubber or a self-adhesive bituminous waterproof material, and has a friction coefficient of less than or equal to 0.1. In the present embodiment, the degree of relative sliding between the horizontal end plate 4 and the steel beam 16 and the degree of relative sliding between the vertical end plate 11 and the steel column 17 are related to the friction coefficient of the unbonding layers 8. If the unbonding layers 8 are designed to have a relatively small friction coefficient between the contact surface of the horizontal end plate 4 and the steel beam 16, and between the contact surface of the vertical end plate 11 and the steel column 17, the elongational/compressive deformation caused by bending of the beam and column can be released smoothly.

In an optional solution of the present embodiment, as shown in FIGS. 4 and 6, the central plate 1 is welded to the horizontal end plate 4 and the vertical end plate 11. With the provision of the horizontal end plate 4 and the vertical end plate 11, the central plate 1 is prevented from bearing a tangential shear stress and is only subjected to a normal stress caused by the brace axial force. Therefore, the welding and fixing of the central plate 1 to the horizontal end plate 4 and the vertical end plate 11 not just facilitates assembling but also increases the structural strength of the gusset plate connection.

Finally, it should be noted that the above embodiments are merely intended to illustrate the technical solutions of the present disclosure, but not intended to limit the disclosure. Although the present disclosure has been described in detail with reference to the foregoing embodiments, it should be understood by those skilled in the art that the technical solutions disclosed in the foregoing embodiments may be modified, or part or all of the technical features thereof may be substituted with equivalents. These modifications or substitutions will not cause the essence of the corresponding technical solution to depart from the scope of the technical solutions of the embodiments of the present disclosure.

The invention claimed is:

1. A gusset plate connection with sliding end plates for buckling-restrained brace, comprising a central plate, a first rib plate and a second rib plate, wherein the gusset plate connection further comprises a horizontal end plate, a first horizontal tie plate, a second horizontal tie plate, bolts, and unbonding layers, wherein the horizontal end plate is perpendicular to the central plate, and is fixedly disposed, corresponding to the first rib plate, on a lower end surface of the central plate;

the first horizontal tie plate and the second horizontal tie plate are both disposed on an upper surface of the horizontal end plate, and located at two sides of the central plate, respectively;

the horizontal end plate is provided with first through holes, the first horizontal tie plate and the second horizontal tie plate are each provided with first mounting holes at positions corresponding to the first through holes, and each of the bolts passes through one of the first mounting holes, one of the first through holes and one of positioning holes in a steel beam, and can be fixed with a nut; and the unbonding layers are disposed at a bottom surface of the horizontal end plate, between the horizontal end plate and the first horizontal tie plate, and between the horizontal end plate and the second horizontal tie plate, respectively.

2. The gusset plate connection with sliding end plates for buckling-restrained brace according to claim 1, wherein the first through holes are in clearance fit with the bolts.

3. The gusset plate connection with sliding end plates for buckling-restrained brace according to claim 2, wherein each of the first through holes is a long slot.

4. The gusset plate connection with sliding end plates for buckling-restrained brace according to claim 3, wherein each of the bolts is a high-strength bolt.

5. The gusset plate connection with sliding end plates for buckling-restrained brace according to claim 3, wherein each of the unbonding layers is made of butyl rubber or a self-adhesive bituminous waterproofing membrane, and each of the unbonding layers has a friction coefficient of less than or equal to 0.1.

6. The gusset plate connection with sliding end plates for buckling-restrained brace according to claim 2, wherein each of the bolts is a high-strength bolt.

7. The gusset plate connection with sliding end plates for buckling-restrained brace according to claim 2, wherein each of the unbonding layers is made of butyl rubber or a self-adhesive bituminous waterproofing membrane, and each of the unbonding layers has a friction coefficient of less than or equal to 0.1.

8. The gusset plate connection with sliding end plates for buckling-restrained brace according to claim 1, wherein the gusset plate further comprises a vertical end plate, a first vertical tie plate and a second vertical tie plate, wherein the vertical end plate is perpendicular to each of the central plate and the horizontal end plate, and is fixedly disposed, corresponding to the second rib plate, on a left end surface of the central plate;

the first vertical tie plate and the second vertical tie plate are both disposed on a right surface of the vertical end plate, and are located at two sides of the central plate, respectively;

the vertical end plate is provided with second through holes, the first vertical tie plate and the second vertical tie plate are each provided with second mounting holes at positions corresponding to the second through holes, and each of the bolts passes through one of the second mounting holes, one of the second through holes and one of positioning holes in a steel column, and can be fixed with a nut; and the unbonding layers are disposed at a left surface of the vertical end plate, between the vertical end plate and the first vertical tie plate, and between the vertical end plate and the second vertical tie plate, respectively.

9. The gusset plate connection with sliding end plates for buckling-restrained brace according to claim 8, wherein each of the second through holes is a long slot.

10. The gusset plate connection with sliding end plates for buckling-restrained brace according to claim 9, wherein number of the first through holes and number of the second through holes are each more than one.

11. The gusset plate connection with sliding end plates for buckling-restrained brace according to claim 10, wherein each of the bolts is a high-strength bolt.

12. The gusset plate connection with sliding end plates for buckling-restrained brace according to claim 10, wherein each of the unbonding layers is made of butyl rubber or a self-adhesive bituminous waterproofing membrane, and each of the unbonding layers has a friction coefficient of less than or equal to 0.1.

13. The gusset plate connection with sliding end plates for buckling-restrained brace according to claim 9, wherein each of the bolts is a high-strength bolt.

14. The gusset plate connection with sliding end plates for buckling-restrained brace according to claim 9, wherein each of the unbonding layers is made of butyl rubber or a self-adhesive bituminous waterproofing membrane, and each of the unbonding layers has a friction coefficient of less than or equal to 0.1.

15. The gusset plate connection with sliding end plates for buckling-restrained brace according to claim 9, wherein the central plate is welded to the horizontal end plate, and the central plate is welded to the vertical end plate.

16. The gusset plate connection with a sliding end plate for buckling-restrained brace according to claim 8, wherein the central plate is welded to the horizontal end plate, and the central plate is welded to the vertical end plate.

17. The gusset plate connection with sliding end plates for buckling-restrained brace according to claim 8, wherein each of the bolts is a high-strength bolt.

18. The gusset plate connection with sliding end plates for buckling-restrained brace according to claim 8, wherein each of the unbonding layers is made of butyl rubber or a self-adhesive bituminous waterproofing membrane, and each of the unbonding layers has a friction coefficient of less than or equal to 0.1.

19. The gusset plate connection with sliding end plates for buckling-restrained brace according to claim 1, wherein each of the bolts is a high-strength bolt.

20. The gusset plate connection with sliding end plates for buckling-restrained brace according to claim 1, wherein each of the unbonding layers is made of butyl rubber or a self-adhesive bituminous waterproofing membrane, and each of the unbonding layers has a friction coefficient of less than or equal to 0.1.

* * * * *